US005417509A

United States Patent [19]

Schwartz

[11] Patent Number: 5,417,509

[45] Date of Patent: May 23, 1995

[54] COCOON POCKET

[75] Inventor: David C. Schwartz, Southboro, Mass.

[73] Assignee: Productive Environments, Inc., Framingham, Mass.

[21] Appl. No.: 195,682

[22] Filed: Feb. 16, 1994

[51] Int. Cl.[6] ..... B42F 13/00

[52] U.S. Cl. ..... 402/79; 281/31; 281/38

[58] Field of Search ..... 402/74, 80 R; 281/15.1, 281/21.1, 31, 38, 29; 283/36, 37

[56] References Cited

U.S. PATENT DOCUMENTS 1,445,953 5/1924 Dick ..... 402/79 X 5,125,561 6/1992 Idstein ..... 402/79 X 5,234,277 8/1993 Le ..... 402/79

*Primary Examiner*—Willmon Fridie

[57] ABSTRACT

This invention relates to dual pocket portfolios, where the pockets face one another on opposing covers of the folio, which pockets are used for holding single or small batch of sheets of paper within the respective inside pockets, and particularly to the construction of a dual pocket enclosure which can be placed in a ring binder and turned without any obstruction, which offers front cover,bottom pocket edge tab marking within the foot print of the host binder covers into which it is bound, and which offers an expansion section at it's spine, along with expansion holes, to permit the enclosure of other pockets.

28 Claims, 5 Drawing Sheets

COCOON POCKET

BACKGROUND OF THE INVENTION

This invention relates to dual pocket portfolios, where the pockets face one another on opposing covers of the folio, which pockets are used for holding single or small batch of sheets of paper within the respective inside pockets, and particularly to the construction of a dual pocket enclosure which can be placed in a ring binder and turned without any obstruction, which offers front cover bottom pocket edge tab marking within the foot print of the host binder covers into which it is bound, and which offers an expansion section at it's spine, along with expansion holes, to permit the enclosure of other pockets.

Dual pocket folios used for presentation have been available which do not provide any holes for attaching to another binder. They are primarily used for "delivery" purposes and also are used for adhoc, stand alone, "piling" and/or temporary batching of leaves at the desk top level. Other dual pockets are folded inside out and have their respective pockets on opposing faces. Yet other dual pockets are folded with their pockets facing one another and include holes for attaching the pocket to a ring binder, however, they are typically "oversized" and therefore, require a large host ring binder for storage where storage results in the edges being within the "foot print of the covers". The holes are symmetrically punched in both covers near the binding edge and the top/bottom, and outer pocket edges of these folios reach opposing top,bottom, and outer edges of the host binder, preventing edge tabbing, and particularly bottom edge tabbing. The category of use of such a pocket is typically coded by color. The pockets can store substantial amounts of paper in batches in either cover pocket but have the holes punched close to the spine or binding edge to facilitate turning in the host ring binder and the expansion of each of the alternative cover pockets. The dual pocket folio of this invention, on the contrary, has the objective of allowing expansion at the spine of the folder, where the purpose of the expansion is to encase, enclose, envelop or otherwise "cocoon" other pockets, in particular one faced pockets such as the "tri-pocket" and the "book edge pocket" which are subjects of other patent applied for pocket configurations.

The pocket according to the invention provides for a dual pocket portfolio which supports attachment to a host ring binder and which provides for an expansion spine by way of an expansion panel on the top cover and elongated holes, and which further has it's holes punched away from the spine to allow for the encasing of other pockets within, and further has the holes punched so that the first hole is close to either the bottom or top edges so as to permit either the bottom edge or the top edge to be substantially aligned with either the bottom or top ring, which inturn leaves room at either the bottom or the top edge for the purpose of cover tabbing for indexed access.

A batching or cocooning dual pocket folio, providing two secure inner pockets for retaining batches of information, which offers expansion at the spine while being retained on a ring binder, which expansion allows for the insertion of other punched leaves and or pockets at the rings between the covers when so bound, and which allows tabbing on the bottom or alternatively the top edge where the tabs remain within the footprint of the host ring binder to which it is attached, have been unavailable.

SUMMARY OF THE INVENTION

The invention therefore relates to dual pocket portfolios, and in particular to a dual pocket portfolio capable of being attached to a host ring binder where the bottom or top edge is offset from the bottom or top edge of the host ring binder, allowing tabs attached at said edges to remain within the foot print of the host binder when the binder is closed.

The invention further relates to tabs which may be formed integrally on the front cover and can be on the top or bottom edge.

The invention relates to a dual pocket folio with covers hingedly joined at a spine therefore, which covers have holes cut in them to allow the folio to be attached to a ring binder at said holes, where the holes are offset from the spine a distance sufficient to allow multiple other similarly punched leaves and/or pockets to be placed on the rings, between the covers, and be held within the covers of the pocket folio of the invention, so bound.

The invention relates to the construction of a dual pocket folio where the spine is formed with an expansion panel as part of a portion of the top cover closest to it's spine. The panel is a flexible portion of the top cover and has elongated holes cut therein so as to permit each hole to slide past the rings as the pocket expands, especially when it is used to encase other pockets within it.

The invention relates to a dual pocket folio according to the invention with a diagonal slice cut from the top or bottom portion of the spine to allow insertion into a standard ring binder so as to permit unobstructed turning of the pocket in the rings.

In particular, the invention relates to the construction of a dual pocket folio according to the invention, formed from one sheet of flexible material such as card stock, where the cut and fold pattern of the card stock allows for the formation of the complete pocket by a sequence of folds and a sealing step.

The invention relates to the construction of pockets of this kind from any flexible material such as spun olefin(tyvek TM /Dupont), polypropelene, vinyl, paper, plastic of other varieties or like and similar substances having a stiffness property ranging from flexible to subtly rigid and being bondable by way of adhesive tabs, electrical bonding, heat sealing, specialty gluing, stapling, and the like.

DETAILED DESCRIPTION OF THE INVENTION

Figure 1:
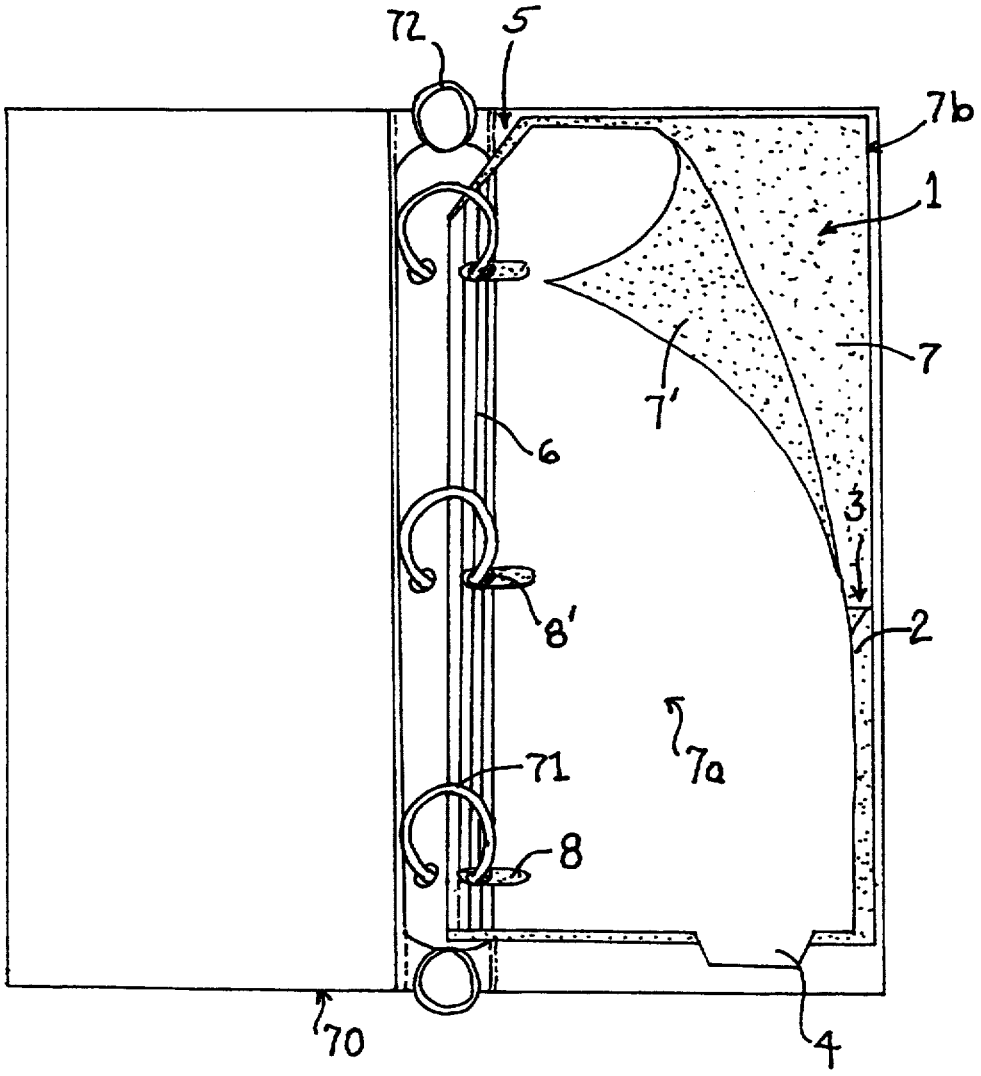
FIG. 1 Shows the front view of the pocket in a three ring binder, with three hole punches on the binding edge of the pocket, with the pocket placed on the right side of the binder with the front panel peeled back to expose one of the two interior pockets. The diagonal cut portion of the spine is cut at the top of the spine, and the holes are offset to allow bottom edge indexing. The index tab is integrally formed on the front cover.

FIG. 1 Shows the front view of the cocoon enclosure as a cocoon pocket folio, 1, in a three ring binder, 70, with three hole punches 8, on the binding edge of the pocket, with the pocket placed on the right side of the binder with the front panel peeled back having inner face 7' and 7, to expose one of the two interior pockets, 3. The diagonal cut portion of the spine is cut at the top of the spine at 5, and the top hole 8 is elongated to allow expansion for enclosure of additional pockets attached to the amme rings but enclosed within the folio. The hole 8 is offset a distance d1 to allow the addition of pockets to the interior.

The expansion panel 6 allows the top cover to rise naturally as pockets are enclosed within the folio. A symmetrical and partially elongated hole along with the expansion panel can be placed on the bottom cover as well to permit symmetrical expansion. In the simple case, a bottom hole is of normal shape and is offset a distance d1 from the spine to allow other pockets with hole distances d1' (offset from their respective binding edges or spines) which distance is shorter than d1 to be fit on the rings between the folio covers. This will keep the folio from "sloshing" about when it is not expanded. The expansion area can be one or more struck areas to facilitate creasing as the pocket is expanded from insertions at the rings within. The index tab, 4, is integrally formed on the front cover.

Figure 2:
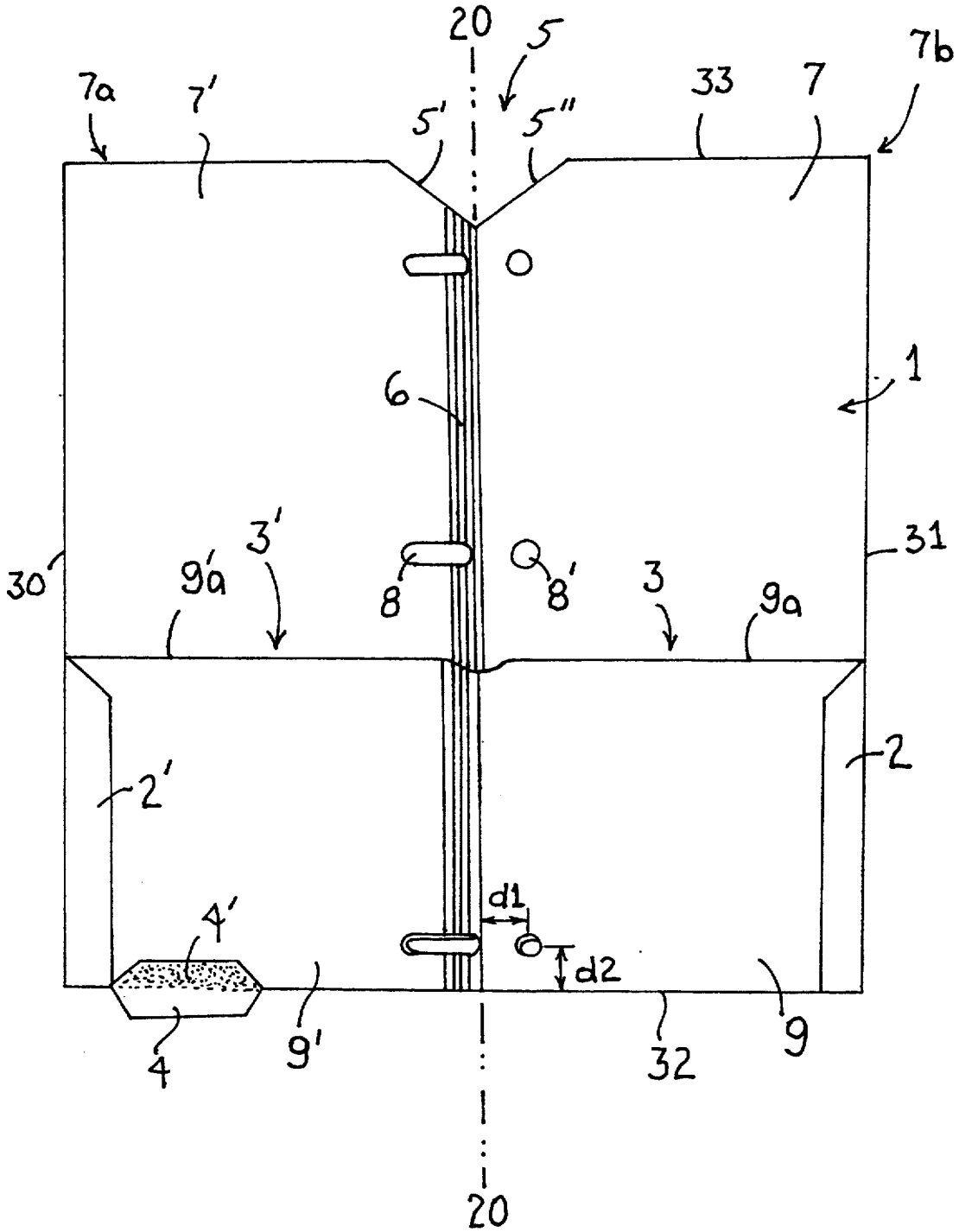
FIG. 2 Shows the pocket of FIG. 1 removed from the ring binder and laid open to expose both interior pockets.

FIG. 2 Shows the pocket, 1, of FIG. 1 removed from the ring binder and laid open to expose both interior pockets 3' and 3. The elongated holes 8 are cut into the expansion panel 6 of the front cover 7*a*. The folio folds about axis 20. The tab 4 is cut from the panel 9'. Tabs 2' and 2 form the closure means for making the two pockets 3 and 3'. Hole 8' is a round hole to keep the folio secure to the ring to which it will be attached and is off set distance d1 from the cocoon enclosure spine and is of standard circular form to secure the folio when it is placed in a ring binder. Distance d2 is set to place the bottom hole 8' substantially aligned with the bottom ring to allow the bottom edge of the dual pocket folio to clear the bottom edge of the binder by a distance substantially equal to the distance of the bottom ring of the host binder from it's bottom edge. Distance d1 is set to allow for the insertion of other leaves at the rings where the other leaves have respective distances, d1', that are less than d1 of the cocoon.

Figure 2A:
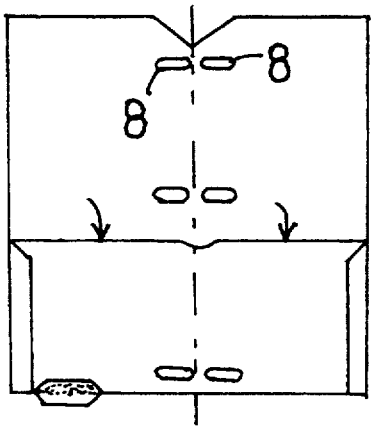
FIG. 2*a* Shows a cocoon enclosure where the front and back covers each have elongated holes and the covers are simply hinged with no expansion panel.
Figure 2B:
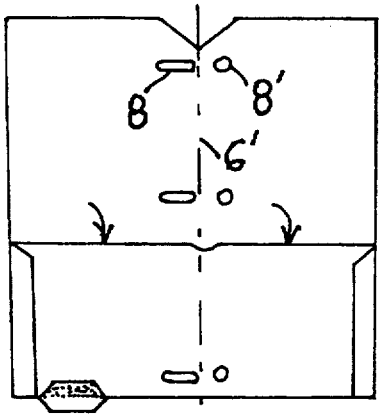
FIG. 2*b* Shows a cocoon enclosure where the front cover has an elongated hole and the bac cover has a round hole and the covers are simply hinged.
Figure 2C:
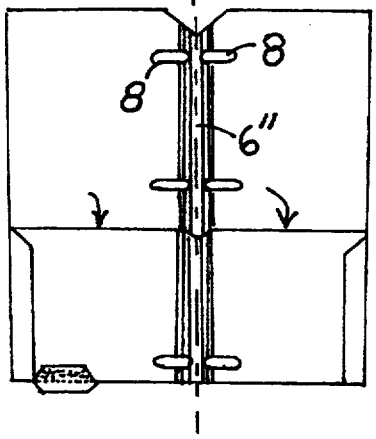
FIG. 2*c* Shows a cocoon enclosure where the front cover and back cover each have elongated holes and the covers are hinged to one another by front and back cover expansion panels.
Figure 2D:
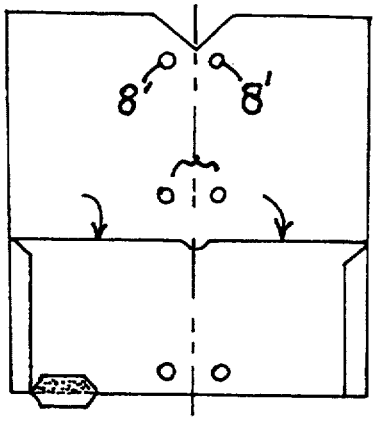
FIG. 2*d* Shows a cocoon with traditional round holes symetrically cut at a sufficient distance to allow expansion at the inner spine.

The invention can be practiced with or without expansion panels and with or without dual sets of elongated holes. FIG. 2*a* Shows a cocoon enclosure where the front and back covers each have elongated holes, 8, and the covers are simply hinged, 6', with no expansion panel. FIG. 2*b* Shows a cocoon enclosure where the front cover has an elongated hole, 8, and the back cover has a round hole, 8', and the covers are simply hinged, 6'. FIG. 2*c* Shows a cocoon enclosure where the front cover and back cover each have elongated holes, 8, and the covers are hinged to one another by front and back cover expansion panels, shown as 6''. FIG. 2*d* Shows a cocoon with traditional round holes, 8', symetrically cut at a sufficient distance to allow expansion at the inner spine, 6', as shown by the bracket. This type of configuration can still work, however it will be necessary to have the cocoon closed before opening the ring binder to prevent tearing of the front cover.

Figure 3:
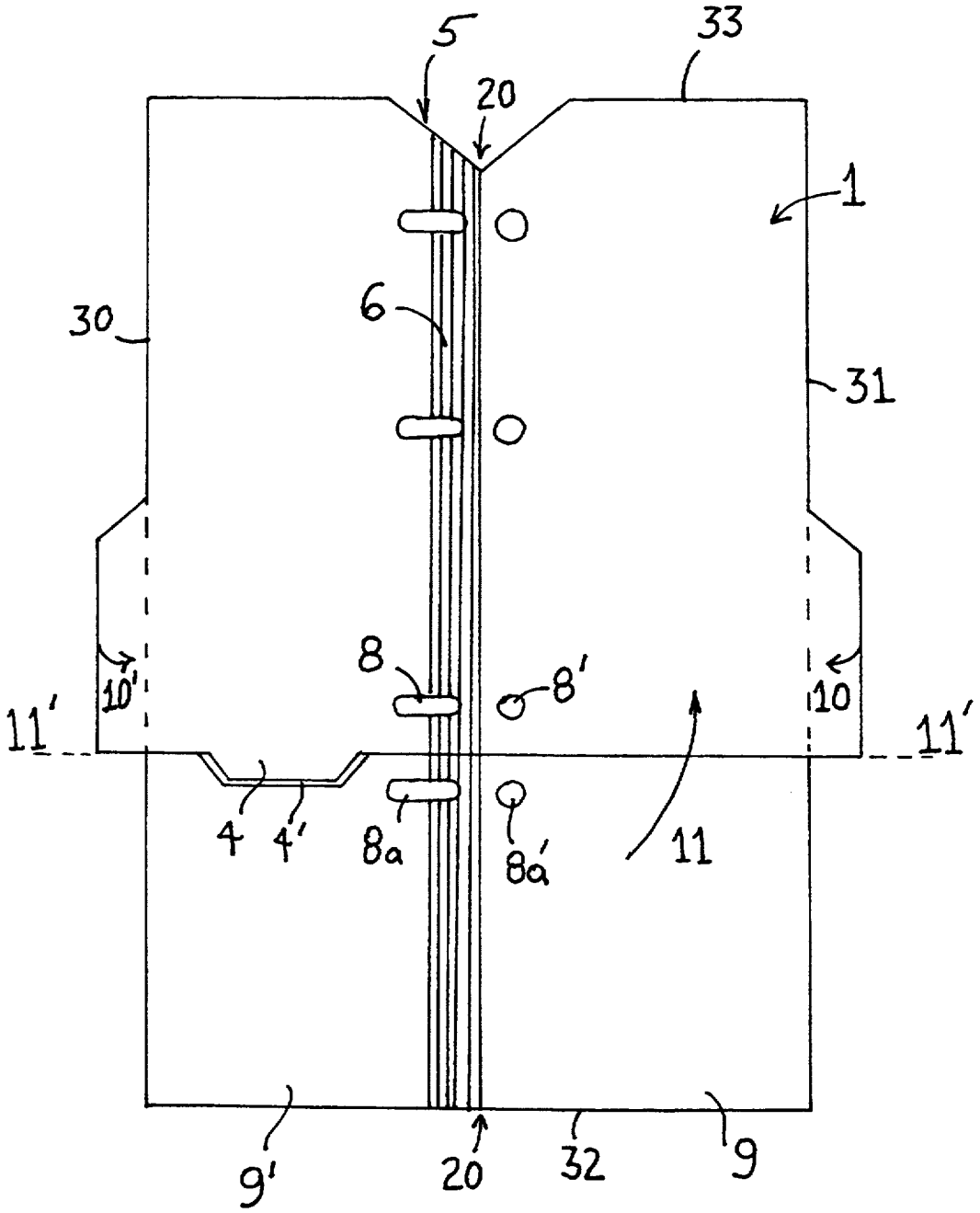
FIG. 3 Shows an unfolded view of one form of construction having dual pocket portfolio.

FIG. 3 Shows an unfolded view of one form of construction having dual pocket portfolio where panels 9 and 9' are laid open and the symmetrical cut of hoses 8*a* and 8*a'* are shown. the pocket is formed by folding the panels 9 and 9'' about axis 11' and attaching tabs 10 by some bonding means which may be adhesive or other means depending on the material used to construct the pocket.

Figure 4:
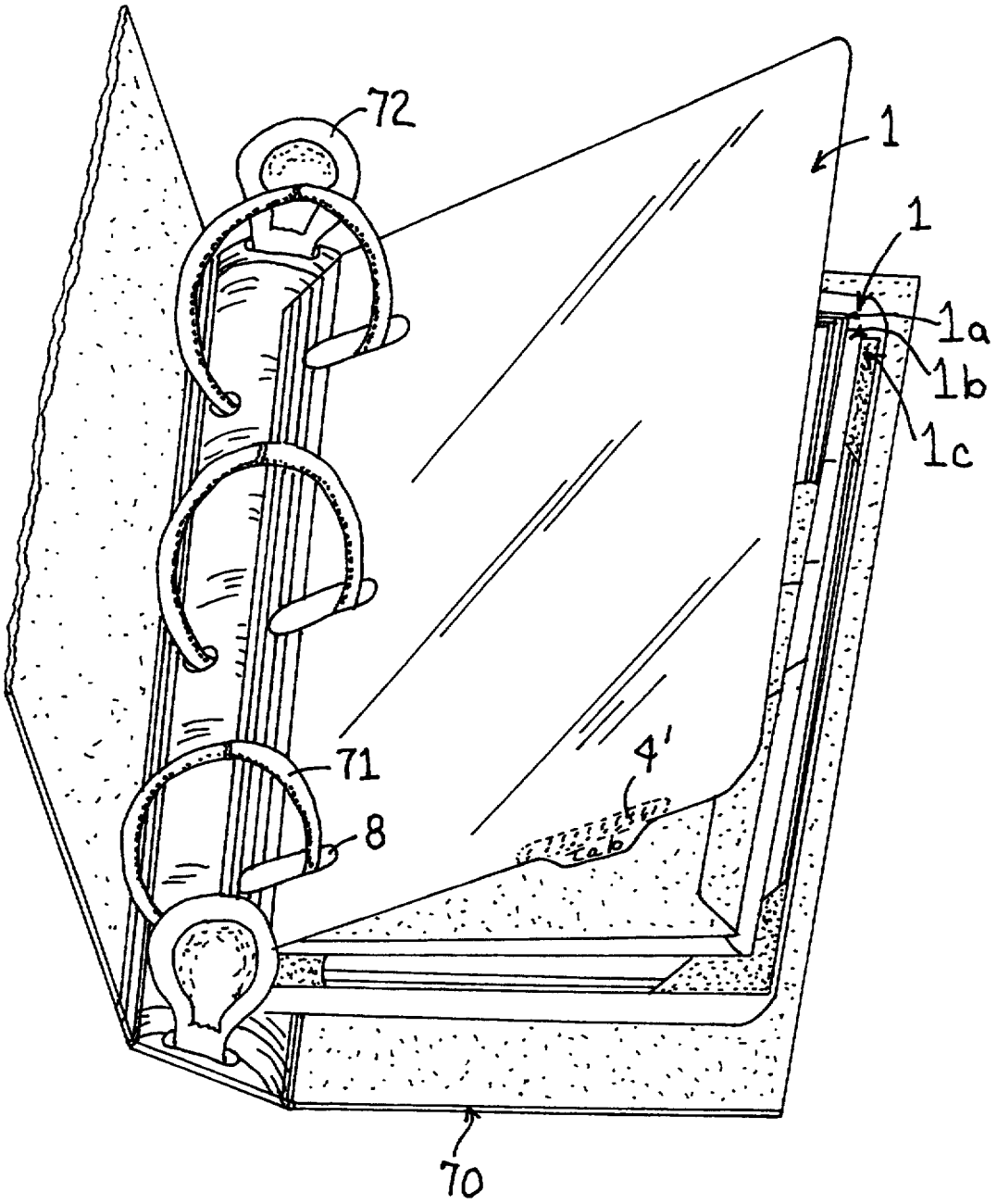
FIG. 4 Shows a ring binder with an outer Cocoon Pocket and three other pockets attached to the binder and held between the covers of the Cocoon.

FIG. 4 Shows a ring binder with an outer Cocoon Pocket, 1 and three other pockets, 1*a*, 1*b*, and 1*c* attached to the binder, 70, at the rings 71, and held between the covers of the Cocoon. The Cocoon has a diagonal cut 5 to avoid the tabs and has a bottom index tab attached 4' on the front cover. The expansion section of the top cover has fold hints which allow e expansion and the holes in the top cover not only allow for the expansion to occur without ripping the holes, but they also allow the rings to be opened when the folder is also open without ripping the top cover holes. The distance d2 is set to allow the bottom horizontal edge of the cocoon to be offset from the bottom horizontal edge of the host binder so as to allow bottom of the pocket indexing. This distance can just as easily be set on the top horizontal edge. The ring binder has opposing top and bottom horizontal edges and these define the foot print of the ring binder. The Cocoon must hold a leaf of standard size as well as encase other pockets. The indexing will be on the top and/or bottom to keep to a standard ring binder width. There is room at the bottom or top of a typical ring binder to host an index tab if the holes of the leaf are offset to shift the leaf up or down. The key is to hold a leaf of standard height, while still having an index tab on either the top or bottom. The offset of the horizontal cocoon edge from the horizontal binder edge, d2, allows for the index to be supported within the foot print of the binder cover.

The optional angle cut 5, allows for the use of this pocket in a ring binder and enable the pocket to miss the ring binder clips. The diagonal cut can be on both ends of the spine or either end. The use of the pocket as a cocoon pocket, in which a set of additional leaves and/or pockets are inserted into the rings within the covers of the folio is made possible. The hole distances d1 and d2 are particularly important for the preferred application of "cocooning". In cocooning, other leaves and pockets will be placed within the enclosing cocoon pocket. The enclosing pocket is retained in a standard ring binder of any ring dimension. Therefore, the offset distance d1 should be "wider", allowing for retention of the pocket array a distance from the ring binder to allow other pockets to be encased. Reinforcing the holes may be desirable to allow for the stress which will occur. Further d2 should be set to permit the bottom edge of the pocket 40 to reside on order of ½" from the bottom of the host ring binder. For this reason, 5 is slit to permit the top corner to turn freely past a host ring binders clips when present. The cocooning construction is fundamental to the application of this pocket configuration in what we are calling "Demand Paging" where one carries or moves around a set of leaves of paper which are related to "current transactions" and the objective for portability achieves the "10/90" rule where 10% of the "mission critical" information you need is available to you 90% of the time, in the cocoon configuration you have at your finger tips at that moment.

Demand paging allows leaves to move through the cocoon, and in particular the other leaves or pockets enclosed therein, on an as needed basis, where, as records recorded on the leaves or held within enclosed pockets "age", they can be moved in batches to respective archives for referential storage and access. This movement can be effected by either lifting out the batches of leaves from either the rings or from in encased pockets, or taking the pocket with its leaves enclosed, and archiving the pocket and the leaf batch as an entity or context. In the first case, demand paging occurs by shuffling leaf batches out of their pockets and performing a secondary binding operation. In the former case, the pocket is deattached from it's primary binding and attached in some fashion, whether by piling or some other form of more secure binding, to a secondary binding.

I claim:

1. A cocoon enclosure comprising a back cover and a front cover, said each of said covers comprising an outer face and an inner face, said back cover being hinged to said front cover, one to the other, at a cocoon enclosure spine, said cocoon enclosure further having opposing top and bottom front and back cover edges and opposing front and back cover outer and inner side edges, said cocoon enclosure further having a plurality of holes including a first set of one or more holes in one of said covers and a second set of one or more laterally elongated holes in said opposing cover, said first and second sets of one or more holes being placed away from said cocoon enclosure spine, said second set of elongated holes being symmetrically positioned to overlay said first set of holes when said front and back cover are folded about said cocoon enclosure spine to a position coincident, one with the other, said elongated set of holes for allowing said cocoon enclosure to be fully opened into a flat position when said cocoon enclosure has a ring of preset diameter threaded through at least one of said plurality of holes.

2. The cocoon enclosure of claim 1 where one of said covers further comprises an index tab intergrally formed there in.

3. The cocoon enclosure of claim 2 where said index tab is formed along one of said opposing top and bottom edges of said one of said covers.

4. The cocoon enclosure of claim 3 where said cocoon enclosure spine has at least one triangular section removed therefrom.

5. The cocoon enclosure of claim 1 where the first of said one or more holes of each of said sets of holes on said each of said front and said back covers, closest to one of said cocoon cover opposing top or bottom edges is substantially at said opposing top or bottom edge.

6. The cocoon enclosure of claim 1 where said each of said front and back cover inner faces further comprises a pocket formed thereon.

7. The cocoon enclosure of claim 6 where said cocoon enclosure is formed from a single section of material.

8. A cocoon enclosure comprising a back cover and a front cover, said each of said covers comprising an outer face and an inner face, said back cover and said front cover being hinged, one to the other, at a cocoon enclosure spine, said cocoon enclosure further having opposing top and bottom front and back cover edges, said cocoon enclosure further having a plurality of holes including a set of laterally elongated holes punched in said back cover and a set of laterally elongated holes punched in said front cover, said each set of said elongated holes being symmetrically cut away from said cocoon enclosure spine, to overlay one set with the other, when said front and back cover are folded about said cocoon enclosure spine to a position coincident, one with the other, and symmetrically cut to overlay one set with the other when said front and said back covers are separated one from the other and substantially parallel one with the other, said each set of elongated holes sliding one over the other to remain in an overlayed position.

9. The cocoon enclosure of claim 8 where said front cover further comprises an index tab intergrally formed there in.

10. The cocoon enclosure of claim 9 where said index tab is formed along one of said opposing edges of said front cover.

11. The cocoon enclosure of claim 10 where said spine has a triangular section removed therefrom.

12. The cocoon enclosure of claim 8 where a first of said plurality of holes on said each of said front and said back covers closest to one of said cocoon cover opposing edges is punched substantially at said opposing edge.

13. The cocoon enclosure of claim 8 where said each of said front and back cover inner faces further comprises a pocket formed thereon.

14. The cocoon enclosure of claim 8 where said cocoon enclosure is formed from a single section of material.

15. A cocoon enclosure comprising a back cover and a front cover, said each of said covers comprising an outer face and an inner face, said back cover being hinged to said front cover, one to the other, at a cocoon enclosure spine, said cocoon enclosure further having opposing top and bottom front and back cover edges, said cocoon enclosure further having a plurality of holes including a first set of one or more holes in one of said covers and a set of one or more laterally elongated holes in said opposing cover, said each set of holes being symmetrically placed away from said cocoon enclosure spine, to overlay one set with the other, when said front and back cover are folded about said cocoon enclosure spine to a position coincident, one with the other, said cocoon enclosure further comprising at least one ring threaded through at least one symetrically opposing hole of said each of said sets of holes on said each of said covers.

16. The cocoon enclosure of claim 15 where one of said covers further comprises an index tab integrally formed there in.

17. The cocoon enclosure of claim 16 where said index tab is formed along one of said opposing top and bottom edges of said one of said covers.

18. The cocoon enclosure of claim 17 where said cocoon enclosure spine has at least one triangular section removed therefrom.

19. The cocoon enclosure of claim 15 where a first of said plurality of holes on said each of said front and said back covers closest to one of said cocoon cover opposing edges is substantially at said opposing edge.

20. The cocoon enclosure of claim 15 where said each of said front and back cover inner faces further comprises a pocket formed thereon.

21. The cocoon enclosure of claim 15 where said cocoon enclosure is formed from a single section of material.

22. The cocoon enclosure of claim 1 where at least a first one of said cocoon enclosure covers further comprises an expansion panel having opposing side edges, where a first of said at least one expansion panel opposing edges is hingedly connected at said cocoon enclosure spine to said other cover, and a second of said at least one expansion panel opposing edges is connected to said inner opposing side edge of said first cover, for positioning said expansion panel intermediate said first one of said covers inner opposing side edges and said cocoon enclosure spine.

23. The cocoon enclosure of claim 15 where said cocoon enclosure further comprises at least one additional pocket, where said one additional pocket further comprises at least one hole placed substantially symmetrically with respect to said cocoon enclosure hole having said ring there through, said at least one additional pocket hole placed withing said cocoon enclosure and having said ring threaded there through said additional pocket hole, for allowing said at least one additional pocket to be enclosed by said cocoon enclosure resulting in said cocoon enclosure forming an outer jacket, for allowing said cocoon enclosure to house said at least one additional pocket being contained therein.

24. The combination comprising: a cocoon enclosure comprising a back cover and a front cover, said each of said covers comprising an outer face and an inner face, said back cover being hinged to said front cover, one to the other, at a cocoon enclosure spine, said cocoon enclosure further having opposing top and bottom front and back cover edges, said cocoon enclosure further having a plurality of holes including a first set of one or more holes in one of said covers and a set of one or more laterally elongated holes in said opposing cover,said each set of holes being symmetrically placed away from said cocoon enclosure spine, to overlay one set with the other, when said front and back cover are folded about said cocoon enclosure spine to a position coincident, one with the other, said cocoon enclosure further comprising at least one ring threaded through at least one symetrically opposing hole of said each of said sets of holes on said each of said covers, and at least one additional pocket comprising at least one hole placed substantially symmetrically with respect to said cocoon enclosure hole set having said ring there through, said at least one additional pocket hole having said ring threaded there through, for allowing said one additional pocket to be housed by said cocoon enclosure resulting in said cocoon enclosure forming an outer jacket, said at least one additional pocket being contained therein.

25. The cocoon enclosure of claim 1 where said cocoon enclosure is made from spun olefin.

26. The cocoon enclosure of claim 1 where said cocoon enclosure is made from plastic.

27. The cocoon enclosure of claim 1 where said cocoon enclosure is made from vinyl.

28. The cocoon enclosure of claim 1 where said cocoon enclosure is made from paper board.

* * * * *